United States Patent [19]

Mae

[11] Patent Number: 4,688,625

[45] Date of Patent: Aug. 25, 1987

[54] METHOD OF VERTICAL CONTINUOUS CASTING

[75] Inventor: Yoshiharu Mae, Urawa, Japan

[73] Assignee: Mitsubishi Kinzoku Kabushiki Kaisha, Tokyo, Japan

[21] Appl. No.: 871,123

[22] Filed: May 30, 1986

Related U.S. Application Data

[63] Continuation of Ser. No. 668,306, Nov. 5, 1984, abandoned.

[30] Foreign Application Priority Data

Nov. 11, 1983 [JP] Japan ..... 58-211839

[51] Int. Cl.[4] ..... B22D 11/00

[52] U.S. Cl. ..... 164/471; 164/462; 164/472; 164/475; 164/483

[58] Field of Search ..... 164/462, 471, 474, 475, 164/507, 415, 423, 493, 498, 258, 459, 424, 425, 464, 483

[56] References Cited

U.S. PATENT DOCUMENTS 3,287,773 11/1966 Woodburn ..... 164/459
3,900,064 8/1975 Chandley et al. ..... 164/493

FOREIGN PATENT DOCUMENTS 903137 2/1954 Fed. Rep. of Germany .
1344168 10/1963 France ..... 164/423
53-8329 12/1978 Japan ..... 164/462
57-5651 5/1982 Japan ..... 164/464
927172 5/1963 United Kingdom ..... 164/425

*Primary Examiner*—Nicholas P. Godici
*Assistant Examiner*—G. M. Reid
*Attorney, Agent, or Firm*—Scully, Scott, Murphy and Presser

[57] ABSTRACT

A continuous casting furnace for manufacturing an elongated cast product, for example, of copper or its alloy includes a housing defining a chamber. A crucible is accommodated within the chamber for holding a casting material. A heater is mounted on the crucible for melting the casting material. A generally vertically-disposed elongated casting nozzle hermetically extends into the chamber. One of the casting nozzle and the crucible is movable toward the other for immersing a lower end of the casting nozzle in the molten casting material in the crucible. The housing is connected to an inert gas source for introducing inert gas into the chamber when the casting material in the crucible is melted. When the lower end of the casting nozzle is immersed in the molten casting material, the molten casting material is moved along the casting nozzle by the pressure of the inert gas in the chamber. A cooling device is associated with the casting nozzle for solidifying the molten casting material when it is passed through the casting nozzle, thereby forming the elongated cast product.

1 Claim, 3 Drawing Figures

METHOD OF VERTICAL CONTINUOUS CASTING

This application is a continuation, of application Ser. No. 668,306, filed 11/5/84, now abandoned.

BACKGROUND OF THE INVENTION

1. Field of the Invention

This invention relates to the art of continuously manufacturing an elongated cast product, for example, of copper and its alloy for use in electronic components.

2. Prior Art

With the development of the electronic industry, a copper alloy for use as lead frames of IC (Integrated Circuit), LSI (Large Scale Integrated Circuit) and the like has recently been required to have a higher strength and a better electric conductivity. Copper alloys containing active metals such as zirconium (Zr), chromium (Cr) and titanium (Ti) can meet with this requirement. However, such a copper alloy product is usually cast in the atmosphere, so that part of the active metals are oxidized to form oxides which are contained in the resultant cast product as inclusions. In addition, when this cast product is subjected to rolling, stringers are caused to develop in the rolled product. Such a product can not be used for lead frames. To avoid this difficulty, starting materials of the above-mentioned copper alloy may be melted and cast into an ingot under vacuum, and then the ingot is rolled into a bar, a strip or the like. However, this procedure is quite expensive and therefore is not practical.

Also, in the electronic industry, there has been a demand for a wire of pure copper having a diameter of less than 50 μm. When such a copper wire is produced with an ordinary casting method, it is susceptible to breakage. It is thought that this difficulty arises from the presence of the inclusions such as oxides in the cast copper. To avoid this, a vacuum melting is necessary, but this is expensive and therefore not practical.

Further, an ingot produced by an ordinary vacuum melting has a relatively large diameter and must subsequently be subjected to a hot processing such as a hot rolling to reduce it to a desired diameter or cross-section. During this hot processing the scales on the ingot are forced into the wire, and part of the iron content of the rolls is transferred to the rolled wire. This also causes the breakage of the wire.

SUMMARY OF THE INVENTION

It is therefore an object of this invention to provide a continuous casting furnace which, in a non-oxiding atmosphere, can melt a casting material and continuously cast the molten casting material into an elongated product.

Another object is to provide a method of continuously manufacturing such a cast product.

According to a first aspect of the present invention, there is provided a continuous casting furnace for manufacturing an elongated cast product which comprises a housing defining a chamber; a crucible having an open top and accommodated within the chamber for holding a casting material; a heater mounted on the crucible for melting the casting material in the crucible to provide a molten casting material; an elongated casting nozzle hermetically connected to the housing and extending into the chamber, the casting nozzle being disposed generally vertically above the crucible, and one of the casting nozzle and the crucible being movable toward the other for immersing a lower end of the casting nozzle in the molten casting material in the crucible; and a cooling means associated with the casting nozzle; the housing being connected to an inert gas source for introducing inert gas when the casting material in the crucible is melted, whereby when the lower end of the casting nozzle is immersed in the molten casting material, the molten casting material is moved along the casting nozzle by the pressure of said inert gas in said chamber, and the cooling means cooling the molten casting material when it is passed through the casting nozzle, thereby solidifying it to form the elongated cast product.

According to a second aspect of the present invention, there is provided a method of continuously manufacturing an elongated cast product which comprises the steps of charging a crucible in a chamber with a casting material; subsequently creating a non-oxidizing atmosphere in the chamber; subsequently heating the crucible to melt the casting material to form a molten casting material; subsequently immersing a lower end of a generally vertically-disposed casting nozzle in the molten casting material in the crucible, an upper end of the casting nozzle being disposed exteriorly of the chamber; subsequently introducing inert gas under pressure into the chamber to increase the pressure in the chamber to move the molten casting material along the casting nozzle; and cooling the molten casting material when it is passed through the casting nozzle, thereby solidifying it to form the elongated cast product.

DESCRIPTION OF THE PREFERRED EMBODIMENTS OF THE INVENTION

Figure 1:
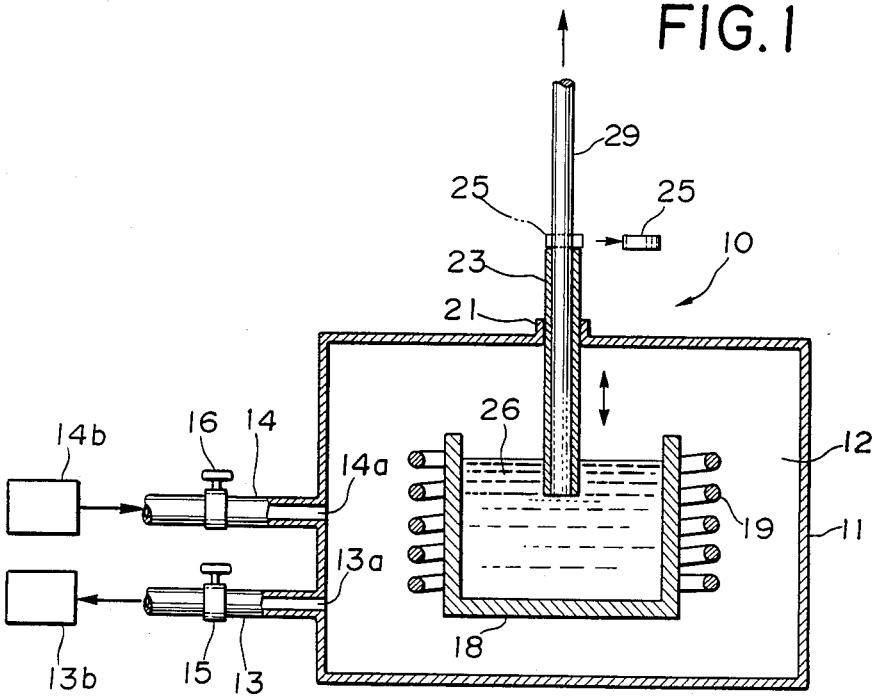
FIG. 1 is a schematic cross-sectional view of a continuous casting furnace provided in accordance with the present invention.

A continuous casting furnace 10 schematically shown in FIG. 1 comprises a box-like air-tight housing 11 of a relatively large size defining a chamber 12. An evacuation conduit 13 is connected at one end to a first port **13*a* formed in the side wall of the housing 11 and at the other end to a vacuum source 13*b* for creating a vacuum of $10^{-3}$ to $10^{-4}$ mm Hg in the chamber 12. Another conduit 14 is connected at one end to a second port 14*a* in the side wall of the housing 11 and at the other end to an inert gas source 14*b* for introducing inert gas into the chamber 12. The conduits 13 and 14 are also connected at the other ends to a vacuum source (not shown) and an inert gas source (not shown), respectively. Valves 15 and 16 are mounted on the conduits 3 and 14**, respectively.

A crucible 18 for melting a casting material such as copper or its alloy is accommodated within the housing 11, the crucible 18 having an open top through which the crucible 18 is charged with the casting material. A high-frequency induction coil 19 is wound around the crucible 18 so that the crucible 18 is adapted to undergo a radiofrequency induction heating to melt the casting material in the crucible 18.

A flanged aperture 21 is formed through a top wall of the housing 11. A casting nozzle 23 in the form of a cross-sectionally circular tube is received in the flanged aperture 21 in an air-tight manner for sliding movement along an axis thereof, the casting nozzle 23 being disposed vertically. The casting nozzle 23 may be of any polygonal cross-section such as a square cross-section. Although not shown in the drawings, the casting nozzle 23 is provided with a water cooling means. The casting nozzle 23 serves as a mold for continuously casting a length of wire as hereinafter more fully described. The casting nozzle 23 is disposed substantially at the center of the crucible 18 and is vertically movable by an actuator means (not shown) between an upper inoperative position in which the lower end of the casting nozzle 23 is retracted from the crucible 18 and a lower operative position in which the lower end of the casting nozzle 23 is immersed in the molten casting material in the crucible 18. A cap 25 is adapted to be removably attached to the upper end of the casting nozzle 23 for closing it in an air-tight manner. The casting nozzle 23 can be made of graphite, but it is preferred that the surface of the bore of the graphite casting nozzle 23 is coated with a protective film made, for example, of SiC when it is intended to produce the cast product of the copper alloy containing the active metals such as Zr and Cr.

The operation of the continuous casting furnace 10 will now be described.

Figure 2:
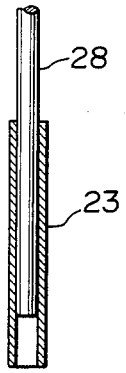
FIG. 2 is a cross-sectional view of a casting nozzle incorporated in the casting furnace, showing a starting wire inserted therein.

First, the valve 15 is opened to evacuate the chamber 12 via the conduit 13 to a vacuum of a predetermined level. At this time, the casting nozzle 23 is held in its upper inoperative position, and the upper end of the casting nozzle 23 is closed by the cap 25. Then, the induction coil 19 is energized to melt the casting material in the crucible 18 to provide a molten casting material 26. Then, the valve 15 is closed to stop the evacuation of the chamber 12, and subsequently the valve 16 is opened to feed inert gas such as argon gas to the chamber 12 via the conduit 14 to increase the pressure of the chamber 12 to the atmospheric pressure. Then, the casting nozzle 23 is moved downwardly to immerse its lower end in the molten casting material 26 in the crucible 18. Then, the cap 25 is detached from the upper end of the casting nozzle 23. Then, one end portion of a starting wire 28 of a circular cross-section is inserted into the casting nozzle 23 from its upper end as shown in FIG. 2, the diameter of the starting wire 28 being slightly smaller than the inner diameter of the casting nozzle 23. The other end of the starting wire 28 is connected to a suitable take-up means (not shown) such as a take-up reel. Then, the pressure of the inert gas in the chamber 12 is increased to a level slightly greater than the atmospheric pressure, so that the molten casting material 26 in the crucible 18 is moved upwardly along the casting nozzle 23 and is brought into contact with the lower end of the starting wire 28. Then, the starting wire 28 is hauled upwardly either continuously or intermittently so that the molten material is cooled by the water cooling means and solidified during the passage through the casting nozzle 23 to produce a cast wire 29 having a circular cross-section corresponding to the bore of the casting nozzle 23. The cast wire 29 so produced is wound around the take-up reel. As the casting operation proceeds, the molteh material 26 in the crucible 18 decreases, and therefore the casting nozzle 23 is gradually moved downwardly during the molting operation to ensure that the lower end of the casting nozzle 23 is dipped in the molten material 26 in the crucible 18. When the molten material 26 in the crucible 18 is almost consumed, the casting operation is stopped. And, the above procedure is repeated.

With the continuous casting furnace 10, the molten casting material, for example, of the copper alloy, containing active metals such as Zr, Cr and Ti, is formed in the vacuum, and this molten material is cast in the atmosphere of the inert gas. Therefore, the active metals are not subjected to oxidation, and any stringer due to oxides of such active metals is not present in the resultant cast product of the copper alloy. Thus, the casting product of a good quality can be obtained. In addition, by virtue of the provision of the elongated casting nozzle 23, the casting product can be obtained in the form of a wire. Therefore, an elongated final product can be easily obtained merely by drawing or rolling the cast wire into a predetermined cross-section. This will reduce the processing cost.

Further, since the molten material 26 is urged to move along the casting nozzle 23 under the influence of the pressure in the chamber 12 against the gravity, the molten casting material in the casting nozzle 23 is solidified under pressure, thereby enhancing the soundness of the cast product.

Further, when the casting operation is completed, the molten material at the lower end of the casting nozzle 23 is finally returned to the crucible 18 upon upward movement away from the crucible 18. Thus, the molten material 26 is subjected to substantially no loss, thereby much improving the yield.

Alternatively, in operation, the use of vacuum can be omitted. In this case, the inert gas is introduced from the inert gas source **14*b* into the chamber 12 when the casting material is melted in the crucible 18. Then, the casting nozzle 23 is moved downwardly to immerse its lower end in the molten casting material in the crucible 18. Then, the starting wire 28 is inserted into the casting nozzle 23, and subsequently the pressure of the inert gas in the chamber 12 is increased, so that the molten casting material in the crucible 18 is moved upwardly along the casting nozzle 23 and is brought into contact with the lower end of the starting wire 28**.

Figure 3:
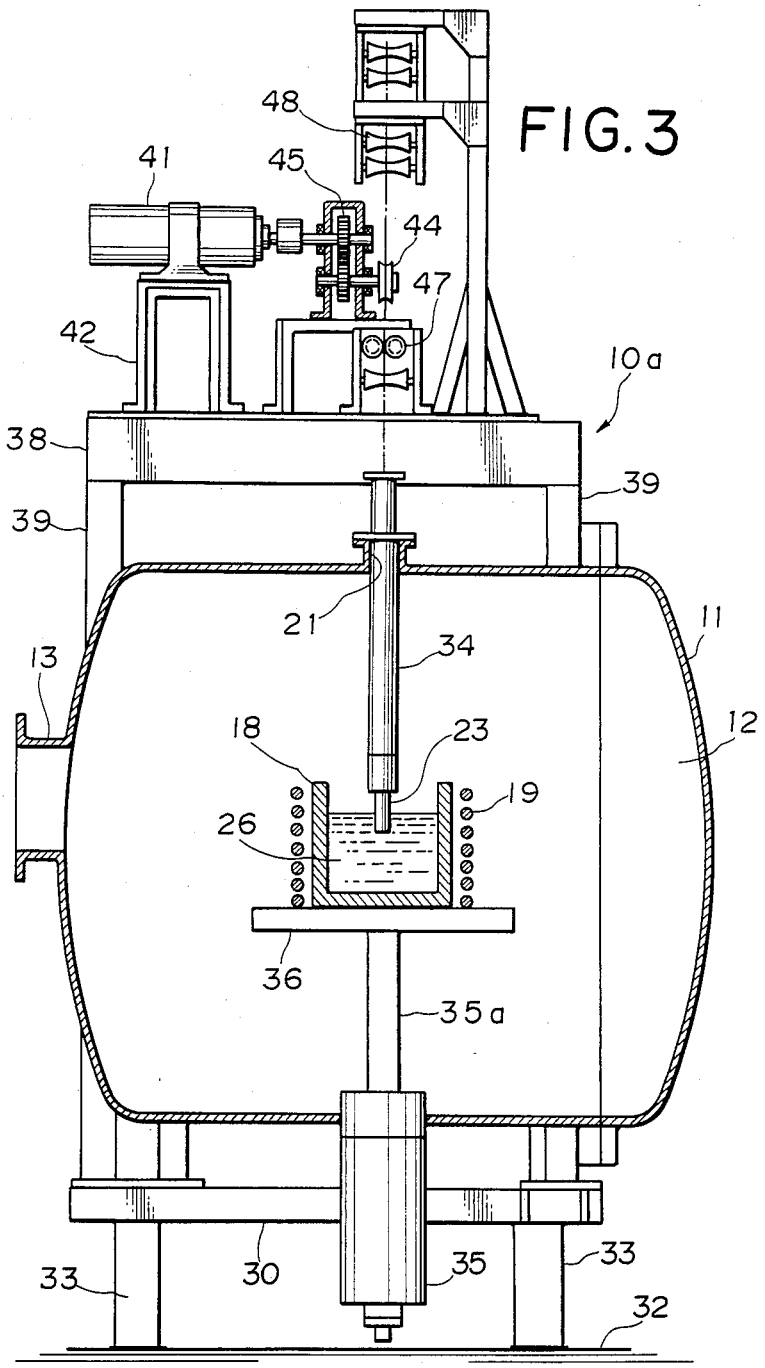
FIG. 3 is a cross-sectional view of a modified continuous casting furnace.

FIG. 3 shows a modified continuous casting furnace **10*a* which comprises a housing 11 defining a chamber 12. An evacuation conduit 13 is connected to the housing 11, and an inert gas-feeding conduit (not shown) is also connected to the housing 11. The housing 11 is supported by legs 31 on a base 30 which is in turn supported on a horizontal floor 32 by legs 33. A water jacket 34 is hermetically received in and secured to a flanged aperture 21. A casting nozzle 23 is received in the water jacket 34, and the lower end of the casting nozzle 23 extends beyond the lower end of the water jacket 34. A hydraulic cylinder 35 is mounted on the base plate 30 and extends hermetically through a bottom wall of the housing 11, the cylinder 35 having a vertically-disposed piston rod 35*a* operatively associated therewith. A horizontal support plate 36 is mounted on the upper end of the piston rod 35*a*. A crucible 18 is placed on the support plate 36. A high-frequency induction coil 19 is wound around the crucible 18. A mounting plate 38 is mounted on the base 30 through legs 39. An electric motor 41 is mounted on the mounting plate 38 through a mounting member 42. An output shaft of the motor 41 is connected to a pair of opposed pinch rolls 44 through a reduction gear train 45**.

The operation of the continuous casting furnace **10*a* is carried out generally, as described above for the continuous casting furnace 10 of FIG. 1. More specifically, the hydraulic cylinder 35 is operated to extend its piston rod 35***a* to move the crucible 18 upwardly toward the casting nozzle 35, so that the lower end of the casting nozzle 23 is immersed in a molten casting material 26 in the crucible 18. Then, a starting wire (not shown) is inserted into the casting nozzle 23, and the pressure of the inert gas in the chamber is increased so that the molten casting material 26 in the crucible 18 is moved upwardly along the casting nozzle 23 and is brought into contact with the lower end of the starting wire as described above for the continuous casting furnace 10 of FIG. 1. In this condition, the starting wire is held by the pinch rolls 44. Then, the motor 41 is operated to move the starting wire upwardly through the pinch rolls 44, so that the continuously-cast wire coming out of the casting nozzle 23 is guided by guide rolls 47, 48 and is wound around a take-up reel (not shown). The molten casting material is cooled by the water jacket 34 when it is passed through the casting nozzle 23 and is solidified to form the cast wire. As the casting operation proceeds, the piston rod 35*a* of the hydraulic cylinder 35 is gradually extended to ensure that the lower end of the casting nozzle 23 is immersed in the molten casting material 26.

The invention will now be illustrated by way of the following EXAMPLES.

EXAMPLE 1

A cross-sectionally circular wire of copper alloy containing 0.4% of Cr and 0.1% of Zr was cast using the continuous casting furnace 10*a* of FIG. 3. The casting nozzle 23 was made of graphite having a protective coating of SiC formed on the surface pf the bore of the nozzle, the nozzle 23 having an inner diameter of 12 mm. The crucible 18 was a graphite crucible (#60) and had a capacity of 50 kg. A power source for the high-frequency induction coil 19 had a capacity of 70 KW. The chamber 12 was held at a vacuum of $1\times10^{-4}$ mm Hg during the melting of the casting material in the crucible 18. After this melting operation, argon gas was introduced into the chamber 12 and the pressure of the argon gas in the chamber 12 was maintained at a pressure of 1.5 kg/cm$^2$G (the atmospheric pressure +0.5 kg/cm$^2$) during the casting operation. In the manner described above, the cross-sectionally circular wire of the copper alloy having a diameter of 12 mm was continuously cast. Subsequently, the cast wire was shaved to a diameter of 10 mm. Then, the diameter of the shaved wire was further reduced to 60 μm by cold rolling and drawing to form a fine wire. The structure of this wire was observed, and it was found that no stringer was present in the fine wire and that the wire had a smooth texture. During the drawing operation, the wire broke less than once per 70 Kg of the wire. Thus, the strength of the wire was excellent, and in addition the electrical conductivity of the wire was excellent. Also, the shaved wire having a diameter of 10 mm was formed by cross-rolling and rolling into a strip having a thickness of 0.2 mm and a width of 40 mm. No stringer was not found in this strip. Then, the strip was subjected to plating. A plating defect occurred less than once per 1 m$^2$ of the strip. Thus, it was best suited for use as a lead frame of IC or the like.

EXAMPLE 2

50 Kg of a wire having a diameter of 12 mm was cast according to the same procedure of EXAMPLE 1 except that the casting material was oxygen free copper and that the casting nozzle 23 of graphite had no coating on the surface of the bore of the nozzle. The wire was subjected to shaving, cold rolling, drawing and annealing so that the diameter of the wire was finally reduced to 25 μm to form a very fine wire. Since the casting material was melted under vacuum, the wire had a negligible amount of inclusions. Also, since the casting was carried out under pressure, casting defects did not develop in the cast wire. Further, since the cast wire coming out of the casting nozzle 23 had such a small diameter as 12 mm, a hot rolling operation could be omitted, so that the cast wire did not have any scales which would otherwise develop during such a hot rolling. Therefore, the cast wire did not break during the later stage processing described above.

What is claimed is:

1. A method of continuously manufacturing an elongated cast product comprising the steps of:

(a) providing a casting apparatus comprising a housing defining a chamber, a crucible mounted within said housing for vertical movement and having an open top, and an elongated casting nozzle with opposite open ends hermetically mounted on said housing, one end of said casting nozzle extending into said chamber, said casting nozzle being disposed generally vertically above said crucible and having a cap removably attached to the upper open end thereof;

(b) charging said crucible with a casting material;

(c) subsequently creating a vacuum in said chamber;

(d) subsequently heating said crucible to melt said casting material therein to form a molten casting material;

(e) subsequently introducing inert gas to said chamber to increase the pressure therein to atmospheric pressure;

(f) subsequently moving said crucible upwardly to immerse the lower end of said casting nozzle in said molten casting material in said crucible;

(g) subsequently removing said cap from the upper end of said casting nozzle and inserting one end portion of a starting wire into said casting nozzle from the upper open end thereof;

(h) subsequently increasing the pressure of the inert gas in said chamber to move said molten casting material upwardly along said casting nozzle to be brough into contact with the lower end of said starting wire;

(i) cooling said molten casting material when it is passed through said casting nozzle, thereby solidfying it to form the elongated cast product; and (j) moving said starting wire upwardly out of said casting nozzle together with the solidified cast product thereby continuously forming an elongated cast product without contact with the ambient atmosphere.

* * * * *